US007338004B2

(12) United States Patent
Niederer

(10) Patent No.: US 7,338,004 B2
(45) Date of Patent: Mar. 4, 2008

(54) LET-OFF DEVICE WITH CONSTANT TENSION

(75) Inventor: Kurt W. Niederer, 3021 Mountainbrook Rd., Charlotte, NC (US) 28210

(73) Assignee: Kurt W. Niederer, Charlotte, NC (US)

( * ) Notice: Subject to any disclaimer, the term of this patent is extended or adjusted under 35 U.S.C. 154(b) by 322 days.

(21) Appl. No.: 11/249,185

(22) Filed: Oct. 13, 2005

(65) Prior Publication Data

US 2006/0081731 A1 Apr. 20, 2006

(51) Int. Cl.
*B65H 59/04* (2006.01)

(52) U.S. Cl. ..... 242/422.4; 242/156.2

(58) Field of Classification Search ..... 242/131, 242/131.1, 156, 156.2, 422.4, 422.5, 416, 242/421, 422, 422.8; 188/82.77, 74, 82.7, 188/186, 76, 75

See application file for complete search history.

(56) References Cited

U.S. PATENT DOCUMENTS

| | | | | |
|---|---|---|---|---|
| 2,766,945 | A * | 10/1956 | Reich | 242/421.1 |
| 2,983,468 | A * | 5/1961 | Perrella | 242/156.2 |
| 3,731,889 | A * | 5/1973 | Alexeff | 242/156.2 |
| 6,010,089 | A * | 1/2000 | Winafeld et al. | 242/421.8 |
| 6,435,445 | B1 * | 8/2002 | Slezak | 242/421.9 |

* cited by examiner

*Primary Examiner*—Peter M. Cuomo
*Assistant Examiner*—William E Dondero

(57) ABSTRACT

A spool (1) mounted on a rotating shaft (2) with a brake drum (3) attached to it is mounted onto a swing lever (4). The swing lever is hinged on a creel channel (6). A loading-force is pushing the brake drum against a fixed brake shoe (9) which is located at such an angle to the swing lever that the tension in the withdrawn strand (10) is not dependant on the diameter of the spool but is constant.

15 Claims, 8 Drawing Sheets

LET-OFF DEVICE WITH CONSTANT TENSION

TECHNICAL FIELD

This invention relates to an apparatus and method for maintaining tension in strands during tangential withdrawal from a spool. More particularly, this invention relates to a tension control device which maintains constant tension in strand materials over variances in operating parameters such as decreasing spool diameter as well as variances of withdrawal speed.

BACKGROUND ART

Strands are unwound from spools in many industrial manufacturing operations. For many of these applications it is important that the tension in the withdrawn strands remain constant during the whole process. Numerous tension control devices for regulating the withdrawal of strand material from a spool exist. Many use a simple brake with a constant brake force applied to the rotating spool. This results is an increase of the strand tension as the spool diameter decreases during the unwinding operation. Other devices employ a force-loaded dancer roll around which the strands are deflected. These dancer rolls are connected to a brake which in turn are applied to the rotating spool. More sophisticated strand tensioning systems use complex and expensive electronic means to measure the strand tension and electronically vary the applied tension with a close-loop feedback or an open-loop control system to achieve constant output tension.

The invention disclosed in this application employs a simple, mechanical tension device consisting of a movable spool-mounting, a spool-brake and a selectable loading force applied to the spool and against the spool-brake. These elements work together in such a manner as to result in constant strand-tension which is not affected by the size of the spool or the operation speed. It is in fact a mechanical, close-loop tension control system. The maintaining of constant withdraw tension at any spool-diameter can be mathematically proven.

SUMMARY OF THE INVENTION

Accordingly it is an object of the present invention to provide constant strand tension by means of a mechanical controller for maintaining uniform strand tension for delivery to a downstream strand processing station.

It is another object of the invention to provide a strand tension controller which allows to select a desired tension level and tension uniformity downstream from the strand tension controller.

It is another object of the invention to provide a strand tension controller which includes means for uniformly and simultaneously setting the strand tension on a plurality of strands being processed.

It is another object of the invention to provide a multiple set of strand tension controllers for which the desired tension level in all strands can be changed simultaneously to fit a specific need in a downstream strand processing station. It is another object of the invention to provide a multiple set of strand tension controllers for which the desired tension level in all strands can be changed simultaneously.

It is an additional object of this invention and its simultaneous changing of tension levels on a multiple set of units to enable each unit to be fine-adjusted individually to make it suited for specific needs in a downstream strand processing station.

It is an additional object of this invention to sense a tension which exceeds the set tension, as for example through a snag of the strand material on the spool, and apply a signaling system for such an occurrence.

BRIEF DESCRIPTION OF THE DRAWINGS

Some of the objects of the invention have been set forth above. Other objects and advantages of the invention will appear as the description of the invention proceeds when taken in conjunction with the following drawings, in which.

PREFERRED EMBODIMENT FOR CARRYING OUT THE INVENTION

Figure 1:
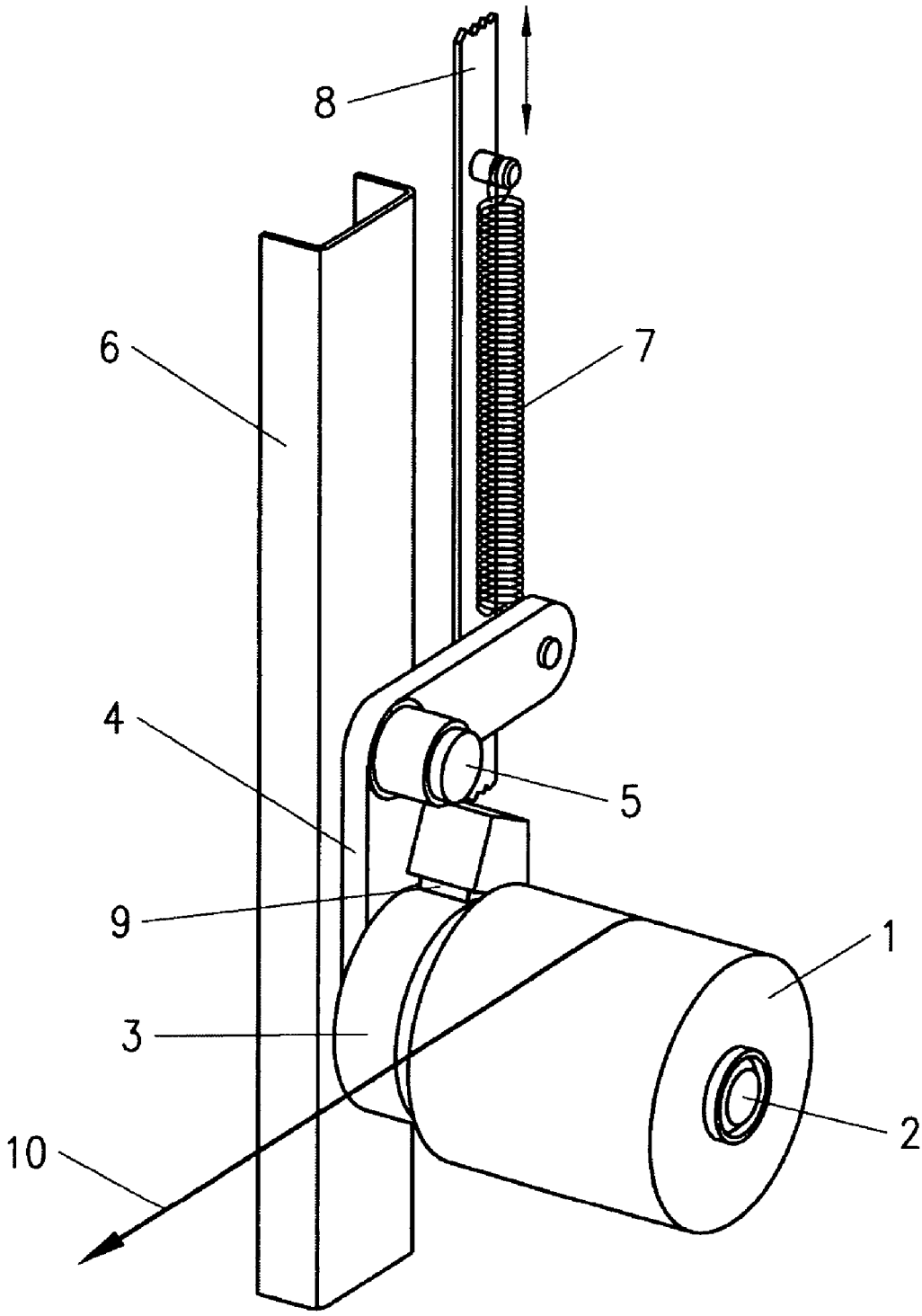
FIG. 1 is a perspective view of the let-off device.

Referring now specifically to the drawings, FIG. 1, strand material is wound unto a spool 1 which is firmly mounted on a rotating shaft 2 which has incorporated a brake drum 3 on one end and can freely rotate in a swing lever 4. The swing lever 4 is pivotably mounted on a pivot shaft 5 , which in turn is fastened to a creel channel 6. One end of a spring 7 is fastened to the swing lever 4 and the other end to a tensioning bar 8. The spring 7 is forcing the brake drum 3, through the swing lever 4, in counterclockwise direction against a stationary brake shoe 9 which is fastened to the creel channel 6. The unrolling strand 10 on the other hand is opposing the spring force in a clockwise direction. Moving the tensioning bar 8 vertically will increase or decrease the tension in the spring 7, resulting in an increase or decrease of the tension in the unrolling strand 10.

Figure 2:
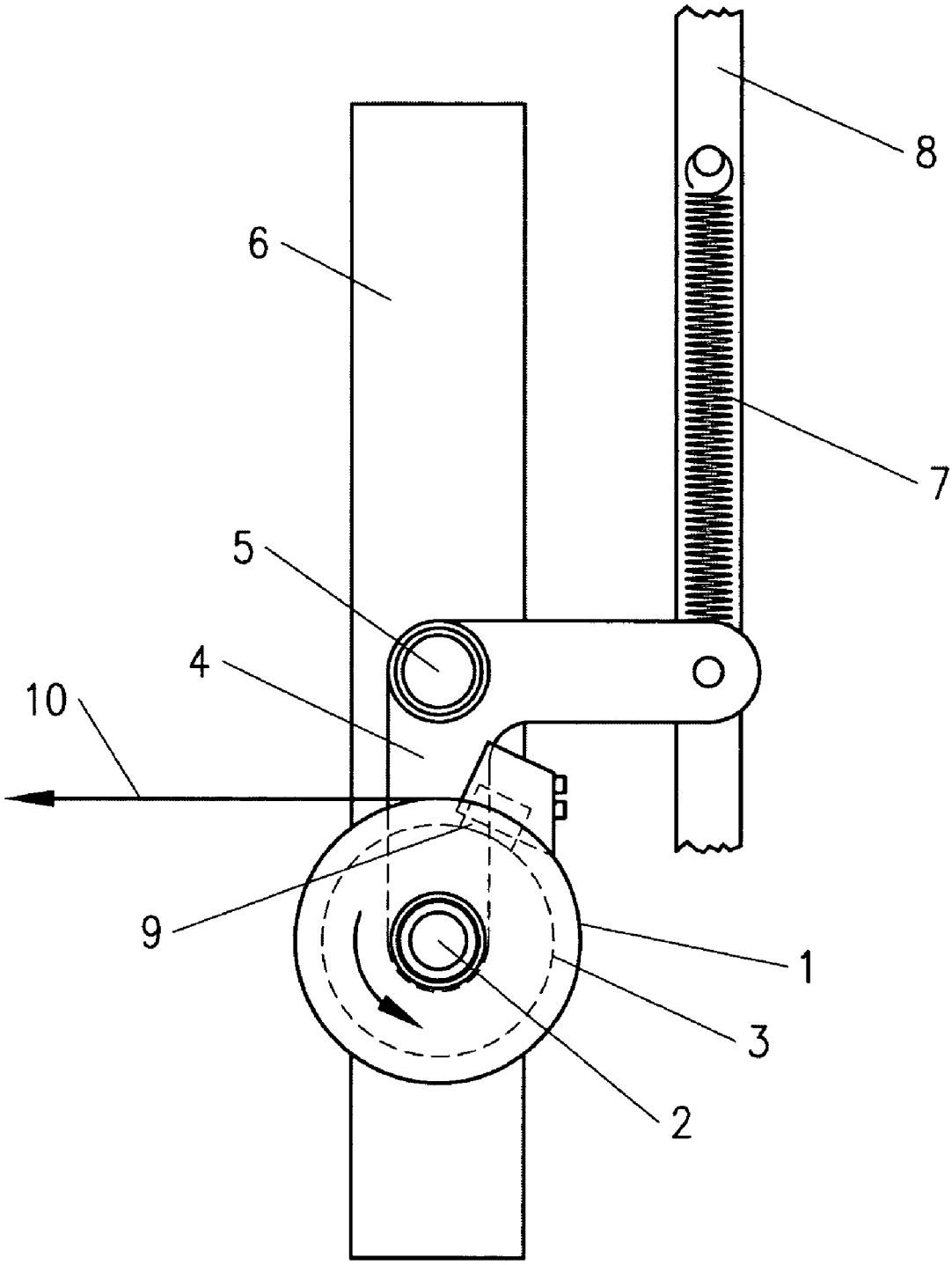
FIG. 2 is a front view of the let-off device.

FIG. 2 shows how the unrolling strand 10 rotates the spool 1 in a counterclockwise direction with the brake shoe 9 through frictional force holding the spool 1 through the brake drum 3 back, hence generating a tension in the unrolling strand 10.

Figure 3:
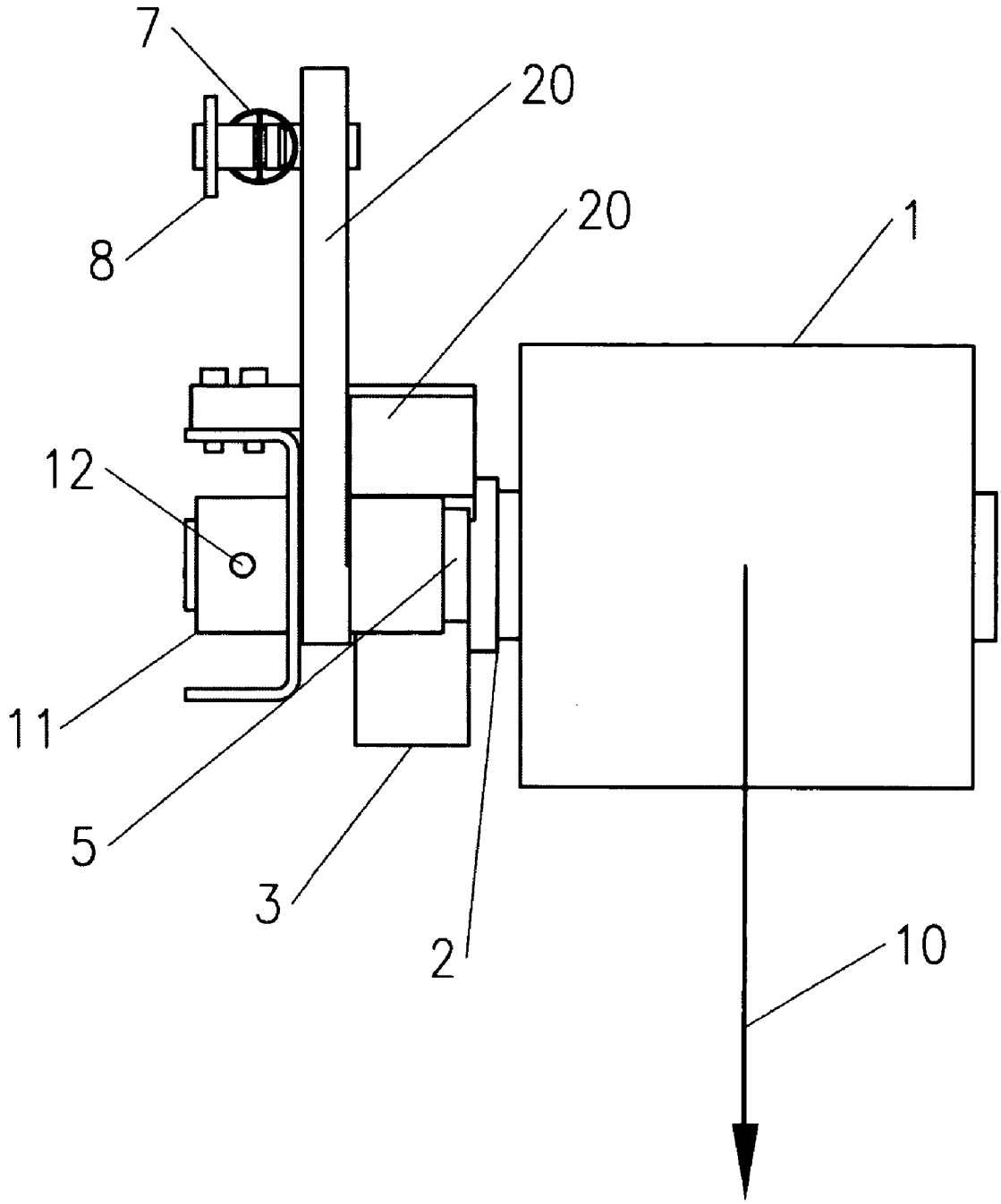
FIG. 3 is a top view of the let-off device.

In FIG. 3 the top view shows in addition to the parts identified in FIGS. 1 & 2 the collar 11 which is welded onto the creel channel 6 and holds the fixed pivot shaft 5 by means of a collar pin 12.

Figure 4:
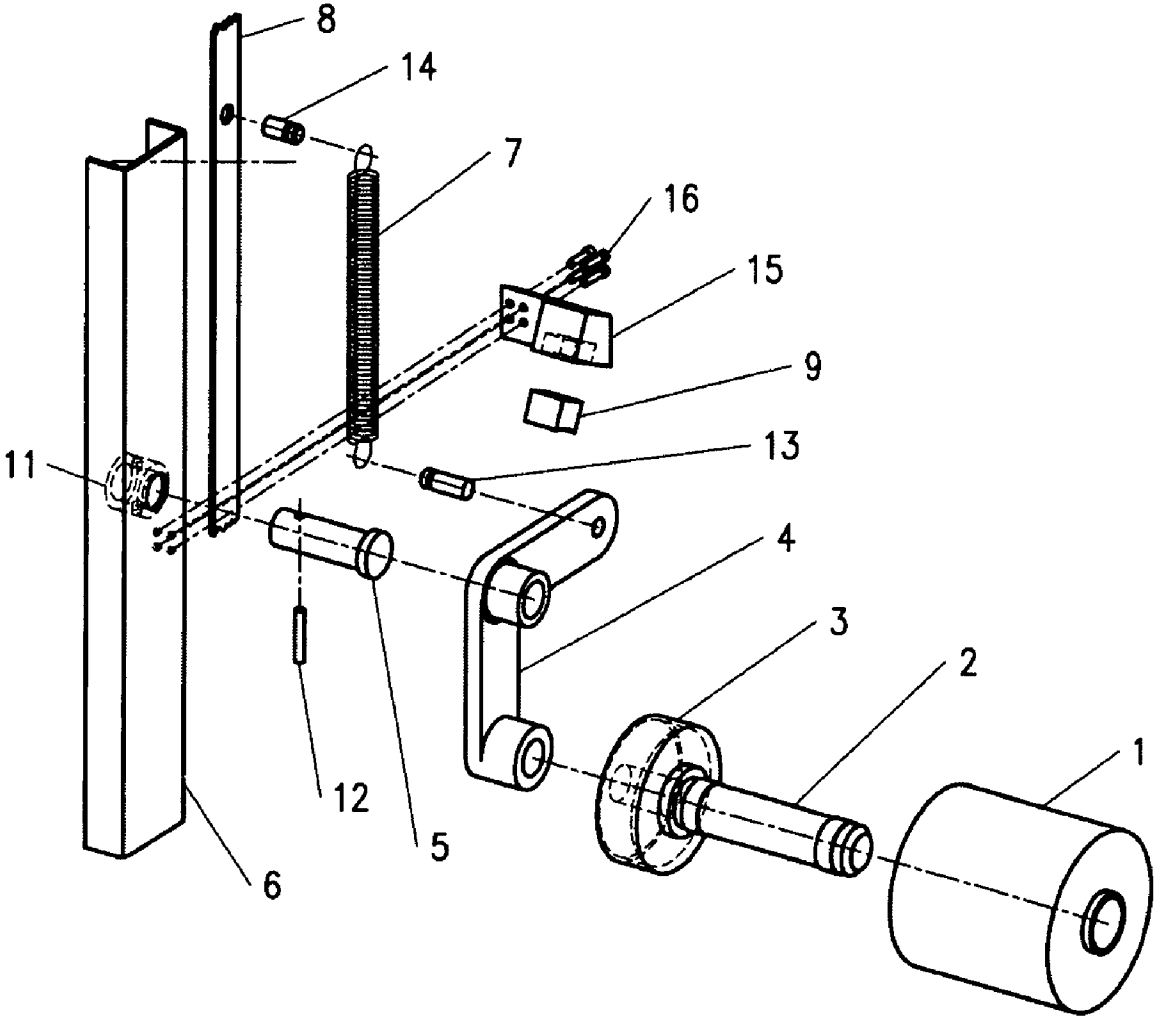
FIG. 4 shows the parts of the let-off devices in an exploded view.

In the exploded view in FIG. 4 each part is shown individually. In addition the mounting of the spring 7 by means of the lever pin 13 which is pressed into the swing lever 4, and the bar pin 14, pressed into the tensioning bar 8 is shown. It also shows the brake housing 15 and the mounting screws 16.

Figure 5:
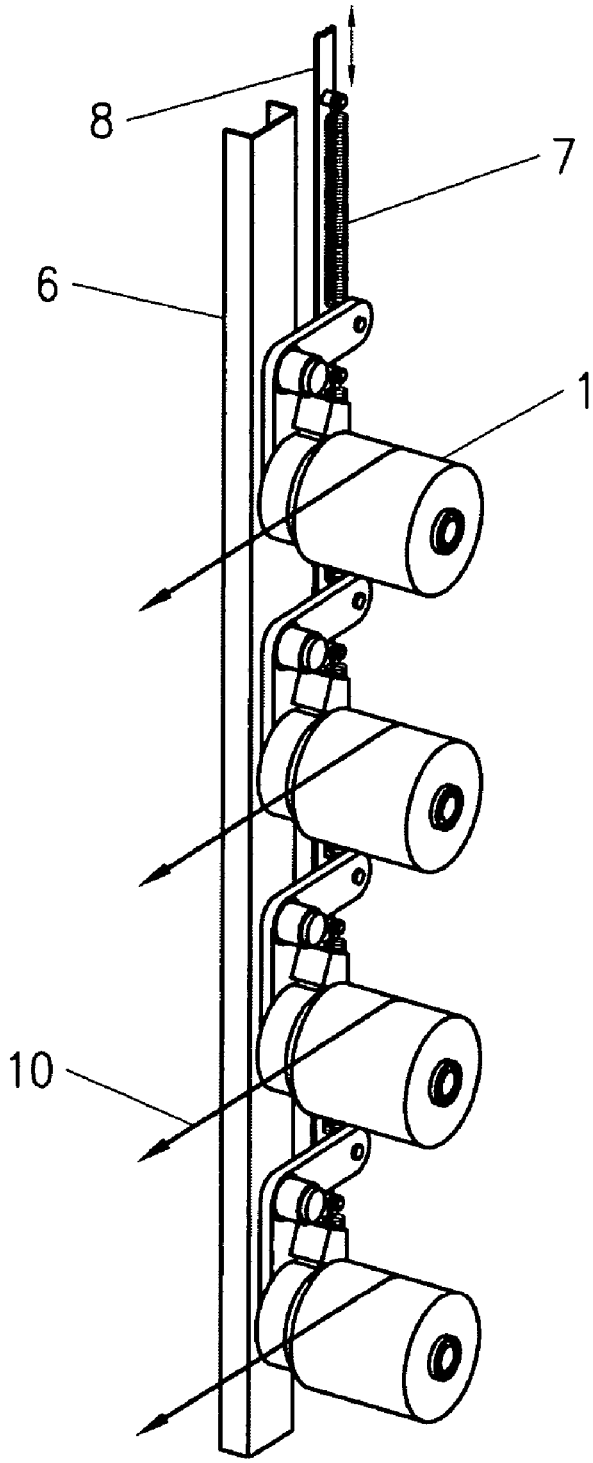
FIG. 5 gives an overview of several let-off devices mounted on a common creel channel.

FIG. 5 shows how several let-off devices are mounted on a creel channel 6. Each unit is tensioned by it's own spring 7 which in this example are all mounted on the same tensioning bar 8 which means that the tension of all unrolling strands 10 will be adjusted together.

Figure 6:
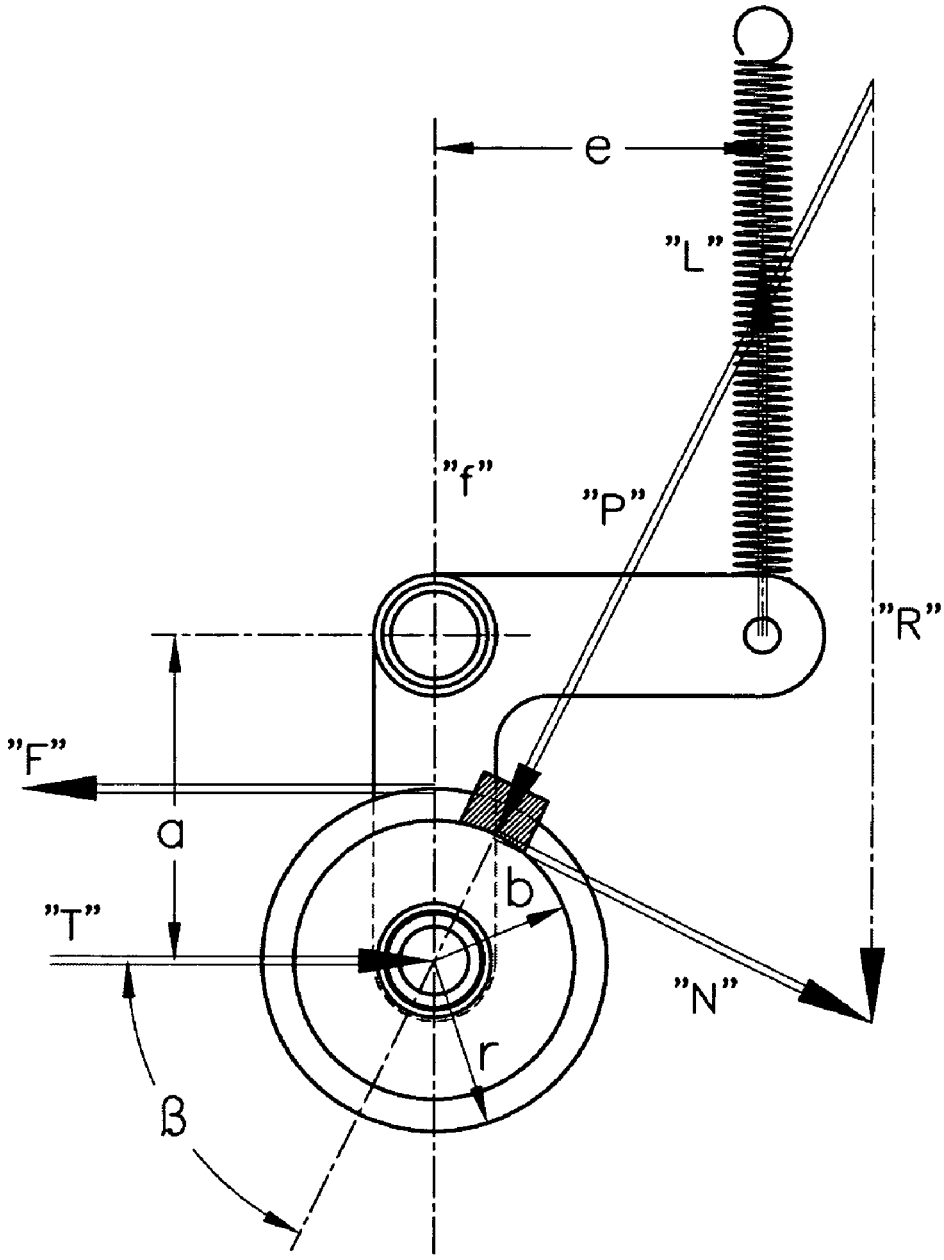
FIG. 6 is a force diagram of the let-off device.

FIG. 6 shows the vital parts of the let-off device with the applied forces and lever-length drawn in. This FIG. is used to show the mathematical interrelation of the forces and to prove that the tension in the unrolling strand 10 is constant for a given force of the spring 7, and is the same no matter how large or small the diameter of the spool 1 is.

Legend:
"F"=Tension in the unrolling strand 10
"L"=Force of the spring 7 on the swing lever 4
"N"=Tangential friction-force
"P"=Radial force component on the brake shoe 9
"R"=Resultant of "N" and "P" in the force-triangle.
"T"=Loading-force generated by the force of the spring 7

$$\text{"}T\text{"}=(L*e)/a$$

a=Center-distance between the rotating shaft 2 and the pivot shaft 5
b=Radius of the brake drum 3
e=Lever length between the spring 7 and the pivot shaft 5
r=Radius of the spool 1
"f"=Axis through the center of the rotating shaft 2 and the pivot shaft 5

Let-Off Calculations

Input Formulas:

[1]

Moments Around "Pivot":

$$(((L*e)/a)*a)-(P*a*\cos\beta)-(F*(a-r))+(N*\sin\beta*(a-(b*\sin\beta))-(N*(\cos\beta)^2*b)=0$$

[2]

Moments Around Package-Center:

$$(N*b)-(F*r)=0$$

[3]

Friction Relationship:

$$N=P*\mu$$

Calculation:

Substituting "N" by (F*r)/b (from [2] and Inserting in [1]:

[4]

$$(((L*e)/a)*a)-(P*a*\cos\beta)-(F*(a-r))+((F*r)/b)*\sin\beta*(a-(b*\sin\beta))-((F*r)/b)*(\cos\beta)^2*b)=0$$

Using Constants in Spread-sheet:

$$(a-r)=k1$$

$$(r/b)*\sin\beta*(a-(b*\sin\beta))=k2$$

$$(r/b)*(\cos\beta)^2*b)=k3$$

New Formula [5]:

$$(((L*e)/a)*a)-(P*a*\cos\beta)-(F*k1)+(F*k2)-(F*k3)=0$$

Substitute "P" with Function of (F):
a) P=(N/μ) (from [3]
b) N=(F*r)/b (from [2]
c) P=(F*r)/(b*μ)

Resulting Formula [6]:

$$(((L*e)/a)*a)-(F*r)/(b*\mu)*a*\cos\beta)-(F*k1)+(F*k2)-(F*k3)=0$$

Using New Constant [k4):

$$k4=(a*\cos\beta*r)/(b*\mu)$$

Solving for "F" [7]:

$$F=(((L*e)/a)*a)/(k1-k2+k3+k4)$$

Substituting T=(L*e)/a Gives:

$$F=(T*a)/(k1-k2+k3+k4)$$

or:

$$F=(T*a)/\{[a-r]-[(r/b)*\sin\beta*(a-(b*\sin\beta))]+[(r/b)*(\cos\beta)^2*b)]+[(a*\cos\beta*r)/(b*\mu)]\}$$

Requirement for the Tension of the Unrolling Strand 10 to be Constant it Must Follow that:

$$a/\{[a-r]-[(r/b)*\sin\beta*(a-(b*\sin\beta))]+[(r/b)*(\cos\beta)^2*b)]+[(a*\cos\beta*r)/(b*\mu)]\}=\text{constant}$$

Through Further Calculation it can be Proven that:

$$F=T=(L*e)/a=\text{constant if}$$

$$\beta=90°-\text{arctg}\ \mu$$

For Example:

If the friction coefficient μ of the brake shoe 9 is 0.3, the angle β has to be 73.3° to satisfy the condition of constant withdrawal tension of the unrolling strand 10. It should be noted that for constant tension in the unrolling strand 10 the direction of the Resultant "R" of tangential friction-force "N" and the radial force component on the brake shoe "P" should be parallel to the centerline "f" through the center of the swing lever 4 and the center of the rotating shaft 2. It also is noteworthy that the length of the center distance "a" as well as the length of the radius "r" have no bearing on the theoretically perfect tension control.

Figure 7:
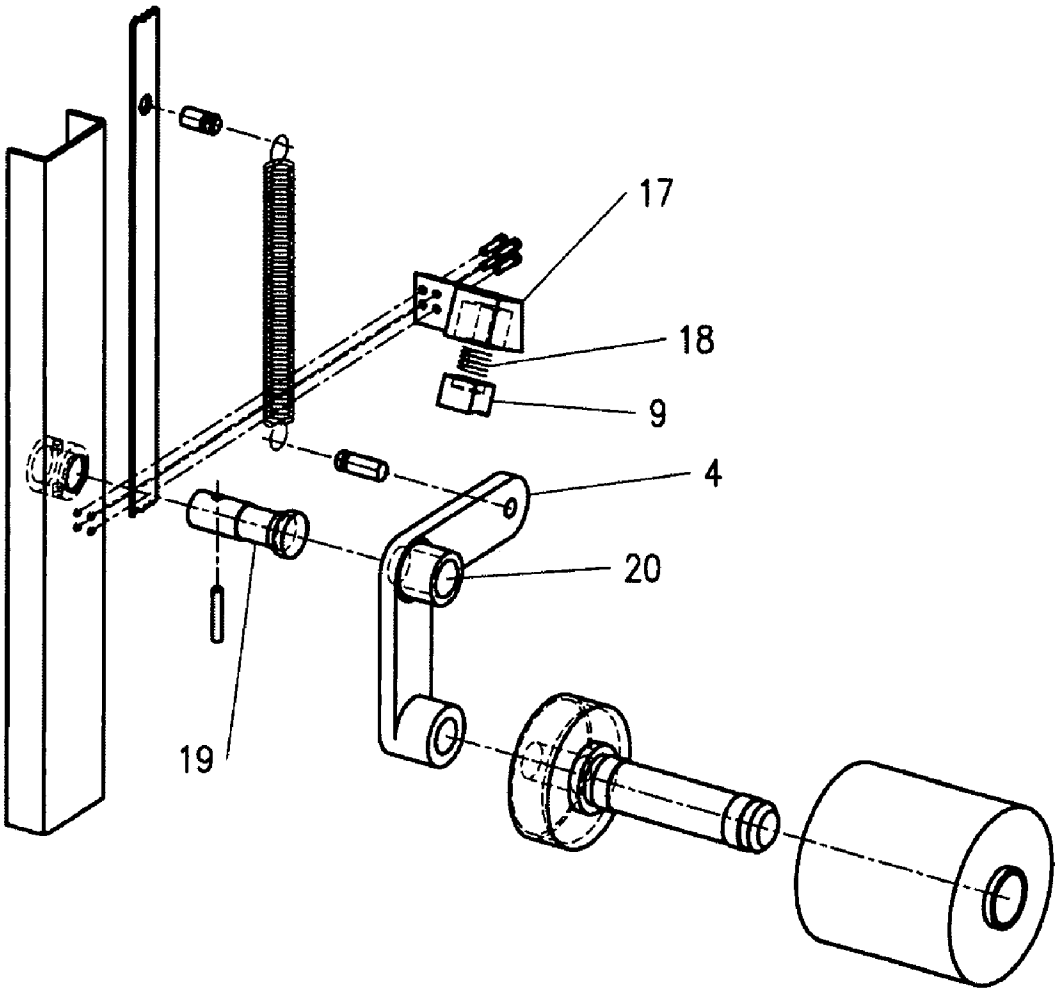
FIG. 7 is a perspective view of a let-off device with a built-in dampening system.

FIG. 7 is very similar to FIG. 4 but shows a let-off device with a built-in dampening system. The brake shoe 9 is spring-loaded by a dampening spring 18 floating in the brake holder 17. In addition a portion of the dampening pivot 19 is turned down to provide a space between the bore 20 of the swing lever 4 and the dampening pivot 19 which is filled with a dampening fluid as for example with silicon.

Figure 8:
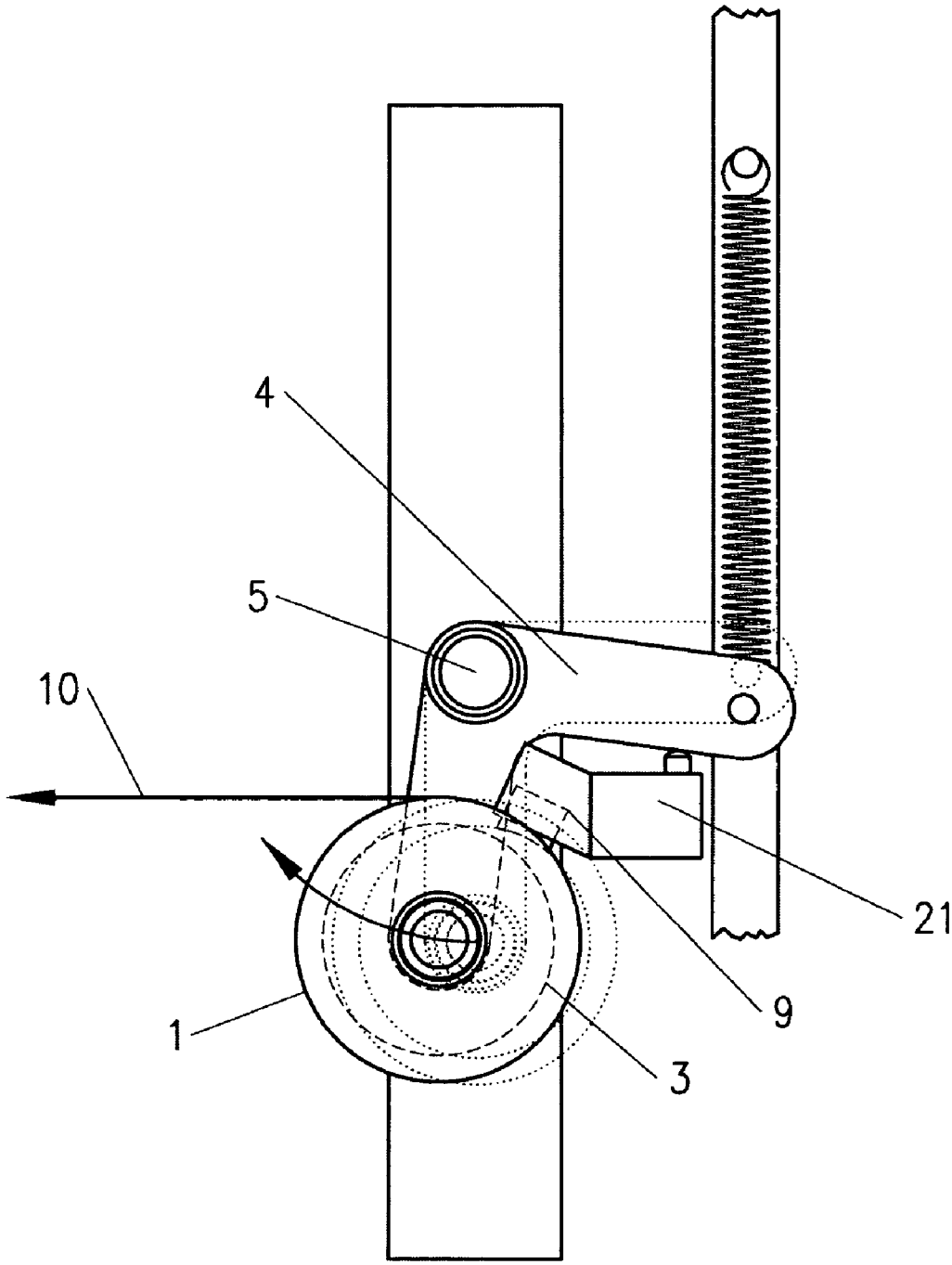
FIG. 8 shows a let-off device with an over-tension switch.

FIG. 8 shows the let-off device equipped with an over-tension switch 21. In case the unrolling strand 10 is trapped on the spool 1 the downstream take-up (not shown) may keep pulling harder and harder in which case the tension in the unrolling strand 10 exceeds the set tension. In this case the spool 1, with the brake drum 3 and the swing lever 4 turn in a clockwise direction and the brake drum 3 lifts from the brake shoe 9. The let-off device in it's normal running position is shown in dotted lines. When the swing lever 4 is rotated clockwise it actuates the over-tension switch 21 which in turn send a signal to a control-station (not shown). This signal can turn on a signaling light (not shown), stop the downstream take-up (not shown), record this happening electronically etc.

Although the invention has been described with reference to specific example embodiments, it will be appreciated that it is intended to cover all modifications and equivalents within the scope of the appended claims. It should also be understood that the present disclosure includes all possible combinations and applications of any individual features recited in any of the appended claims.

NUMBERING IN DRAWINGS spool 1
rotating shaft 2
brake drum 3
swing lever 4 pivot shaft 5
creel channel 6
spring 7
tensioning bar 8
brake shoe 9
unrolling strand 10
collar 11
collar pin 12
lever pin 13
bar pin 14
brake housing 15
mounting screws 16
brake holder 17
dampening spring 18
dampening pivot 19
bore 20
over-tension switch 21

What is claimed is:

1. A tension control device for tensioning strand material being withdrawn tangentially from a spool comprising:

(a) a fixed support;

(b) a swing lever fastenedly hinged about a pivot point to said fixed support at one end;

(c) a spindle assembly containing a brake drum and a spool carrying strand material where said spindle assembly is rotatably mounted to said swing lever;

(d) a fixed brake shoe which contacts the brake drum;

(e) said strand material by being pulled from said spool trying to move said spindle assembly away from said brake shoe;

(f) a loading force applied to said swing lever pulling said spindle assembly against said brake shoe.

2. A tension control device for tensioning strand material being withdrawn from a spool according to claim 1 wherein the spool comprising wound strand material is lined up with the pivot point of said swing lever in generally vertical direction.

3. A tension control device for tensioning strand material being withdrawn from a spool according to claim 2 where said fixed brake is located at such an angle to the centerline through the center of said swing lever and said center of the rotating shaft that the tension in said unrolling strand is constant from the time said spool is full to the time said spool is empty.

4. A tension control device for tensioning strand material being withdrawn from a spool according to claim 1 where said brake shoe has some freedom to move in a generally axial direction to said brake drum in order to absorb some possible shocks in the tension of said unrolling strand.

5. A tension control device for tensioning strand material being withdrawn from a spool according to claim 1 where the motion of said swing lever is dampened in order to absorb some possible shocks in the tension of said unrolling strand.

6. A tension control device for tensioning strand material being withdrawn from a spool according to claim 4 where the motion of said swing lever is dampened in order to absorb some possible shocks in the tension of said unrolling strand.

7. A tension control device for tensioning strand material being withdrawn from a spool according to claim 1 where an increase beyond the set tension rotates said swing lever out of contact of said brake shoe with said brake drum and through this motion actuates a sensing device signaling an over-tension.

8. A method of controlling tension in a strand unrolling from coils wound on a rotating spool in tangential direction, comprising the steps of:

(a) pulling a strand from said spool which is firmly mounted together with a concentric brake drum on a rotatable spindle, where the spindle mounting is confined against torsion and linearly in two axis but has freedom of movement in the general direction of said unrolling strand;

(c) pulling said brake drum in opposite direction to said unrolling strand against a fixed brake shoe to generate a desired tension in said strand.

9. A method of controlling tension in a strand unrolling from a rotating spool according to claim 8 where said rotating spool is rotatably mounted to one end of a swing lever and the other end of said swing lever is hinged on a fixed pivot shaft.

10. A method of controlling tension in a strand unrolling from a rotating spool according to claim 9 where said spool is located vertically below the swing lever.

11. A method of controlling tension in a strand unrolling from a rotating spool according to claim 9 where said spool is located vertically above the swing lever.

12. A method of controlling tension in a strand unrolling from a rotating spool according to claim 9 where said fixed brake shoe is positioned at a specific angle to said lever axis in order to result in a constant tension of said strand, independent from the spool diameter.

13. A method of controlling tension in a strand unrolling from a rotating spool according to one of claims 8 to 12 where the brake system is dampened to absorb some possible shocks in the tension of said strand.

14. A method of controlling tension in a strand unrolling from a rotating spool according to one of claims 8 to 12 where the swinging lever is dampened to absorb some possible shocks in the tension of said strand.

15. A method of controlling tension in a strand unrolling from a rotating spool according to one of claims 8 to 12 where an over-tension generates a signal to indicate such over-tension.

* * * * *